US005966937A

United States Patent [19]

Graves

[11] Patent Number: 5,966,937

[45] Date of Patent: Oct. 19, 1999

[54] RADIAL INLET SWIRLER WITH TWISTED VANES FOR FUEL INJECTOR

[75] Inventor: Charles B. Graves, Jupiter, Fla.

[73] Assignee: United Technologies Corporation, Hartford, Conn.

[21] Appl. No.: 08/947,593

[22] Filed: Oct. 9, 1997

[51] Int. Cl.[6] ..... F02K 3/14

[52] U.S. Cl. ..... 60/748; 60/740; 239/400; 239/406

[58] Field of Search ..... 60/737, 746, 747, 60/748, 749, 740; 239/400, 405, 406, 463

[56] References Cited

U.S. PATENT DOCUMENTS

| | | | |
|---|---|---|---|
| Re. 30,160 | 11/1979 | Emory, Jr. et al. . | |
| 2,095,242 | 10/1937 | Dick | 239/400 |
| 2,803,296 | 8/1957 | Young | 239/406 |
| 3,570,242 | 3/1971 | Leonardi . | |
| 3,853,273 | 12/1974 | Bahr et al. . | |
| 3,886,728 | 6/1975 | Quinn | 60/748 |
| 3,901,446 | 8/1975 | Petreikis, Jr. . | |
| 3,915,387 | 10/1975 | Caruel et al. | 239/400 |
| 3,937,011 | 2/1976 | Caruel et al. | 239/406 |
| 3,972,182 | 8/1976 | Salvi | 60/748 |
| 4,194,358 | 3/1980 | Stenger . | |
| 4,221,558 | 9/1980 | Santisi | 239/406 |
| 4,653,278 | 3/1987 | Vinson et al. | 60/748 |
| 4,842,197 | 6/1989 | Simon et al. . | |
| 4,991,398 | 2/1991 | Clark et al. . | |
| 5,186,607 | 2/1993 | Yang et al. | 415/183 |
| 5,490,378 | 2/1996 | Berger et al. | 60/748 |
| 5,603,211 | 2/1997 | Graves . | |
| 5,833,141 | 11/1988 | Bechtel, II et al. | 60/748 |

*Primary Examiner*—Ted Kim
*Attorney, Agent, or Firm*—Norman Friedland

[57] ABSTRACT

The fuel injector for a combustor of a gas turbine engine of the high shear design type is configured to include two swirlers with passages where the vanes in the inner swirler of the inner swirler in the passage which is closest to the centerline of the fuel nozzle includes a judiciously located twist and together with the proper flow ratio between the two swirl passages and the proper swirl angle of the flow stream in each of the passages provide an enhanced fuel injector with improved lean blowout and high altitude relight characteristics while assuring a stable recirculation region in the combustion zone.

14 Claims, 4 Drawing Sheets

RADIAL INLET SWIRLER WITH TWISTED VANES FOR FUEL INJECTOR

TECHNICAL FIELD

This invention relates to fuel nozzles for combustors for gas turbine engines and particularly to the configuration of the vanes of the swirler.

CROSS REFERENCE

This invention relates to the invention disclosed and claimed in the patent application filed contemporaneously with this patent application by co-inventors, Charles Graves, the inventor of this patent application and Clifford E. Smith, entitled "Fuel Injector For Gas Turbine Engine", and identified as Attorney Docket F-5413.

BACKGROUND OF THE INVENTION

As is well known in the gas turbine engine technology it is desirable to operate the combustor at optimum efficiency while achieving good lean blowout, altitude relight, void of smoke and pollutants while being able to increase the temperature of the hot gases while maintaining the integrity of the combustor liner as well as being cost effective. Scientists and engineers have been experimenting with the designs of the fuel nozzles for many years in attempts to maximize the efficacy of the combustor. This invention constitutes an improvement over the fuel nozzle described in U.S. Pat. No. 5,603,211 granted to Charles B. Graves, the inventor of this patent application, on Feb. 18, 1997 entitled "Outer Shear Layer Swirl Mixer For A Combustor" which is commonly assigned to United Technology Corporation. As disclosed in the U.S. Pat. No. 5,603,211, supra, the fuel nozzle includes a swirler design that includes three air swirling passages, namely, a center duct and two annular ducts located radially outward from the fuel injector. These passages include vanes for swirling the incoming air and are tailored to have significantly different swirl angles to yield low smoke production and high relight stability in high temperature rise combustors. In the construction of the fuel nozzle in the U.S. Pat. No. 5,603,211, supra, the high swirl passage was confined to the vicinity of the fuel injector and a counter-rotating annular passage surround it which provided both the features of a high swirl and low swirl device.

While this structure in the U.S. Pat. No. 5,603,211, supra, produced high swirl angles along the centerline and low swirl angles along the injector prefilmer, in evaluating this device certain disadvantages were noted. Namely, the mixing shear layer between the two counter-rotating passages appeared to impede the transport of the spray to the prefilmer, and in general, the less the amount of flow in the counter rotating passage the better the injector performed. It was also noted that the mixing of the passages produced a pressure loss which dictated that the vane areas needed to be increased to levels larger than what would normally be required in a standard high shear design.

In addition to the above-referred to patent there are a plethora of fuel nozzles that are disclosed in the prior art that include swirlers and injectors for combustors of gas turbine engines and all of which provide recirculation zones for stabilizing combustion. Examples of prior art fuel nozzles are disclosed in U.S. Pat. Nos. Re. 30,160 reissued in Nov. 27, 1979 and granted to Emory, Jr. et al entitled Smoke Reduction Combustion Chamber, U.S. Pat. No. 3,570,242 granted to Leonardi on Mar. 16, 1971, entitled Fuel Premixing For Smokeless Jet Engine Main Burner, U.S. Pat. No. 4,991,398 granted to Clark et al on Feb. 12, 1991 entitled Combustor Fuel Nozzle Arrangement all of which are commonly assigned to United Technologies Corporation, the assignee of this patent application. Additional patents of interests are U.S. Pat. No. 3,853,273 granted to Bahr et al on Dec. 10, 1974 entitled Axial Swirler Central Injection Carburator, U.S. Pat. No. 3,901,446 granted to Petreikis, Jr. on Aug. 26, 1975 entitled Induced Vortex Swirler, U.S. Pat. No. 4,194,358 granted to Stenger on Mar. 25, 1980 entitled Double Annular Combustor Configuration and U.S. Pat. No. 4,842,197 granted to Simon et al on Jun. 27, 1989 entitled Fuel Injection Apparatus And Associated Method.

I have found that I can provide a fuel nozzle having a fuel injector at the center, an inner swirl passage adjacent to the fuel injector and coaxial therewith and an annular swirl passage concentrically mounted relative to the inner passage and having the vanes in the inner swirl passage contoured with a discretely shaped twist which will not only duplicate the advantages of the structure disclosed in the U.S. Pat. No. 5,603,211, supra but will obviate the disadvantages thereof. Obviously, the elimination of the third passage will not only lessen the complexity of the design but also will reduce costs.

DISCLOSURE OF THE INVENTION

It is an object of this invention to provide improved fuel nozzle for the combustor of a gas turbine engine which includes an inner swirl passage and an annular swirl passage and the contour of the vanes in the inner swirl passage are designed with a particular twist.

A feature of this invention is the incorporation of an inner swirl passage surrounding the fuel injector and being in co-axial relationship thereto and an outer annular swirl passage concentrically mounted relative to the inner swirl passage with twisted vanes in the inner swirl passage and the majority of the total airflow being admitted into the combustor through the inner swirl passage.

The foregoing and other features of the present invention will become more apparent from the following description and accompanying drawings.

BEST MODE FOR CARRYING OUT THE INVENTION

Performance of the fuel nozzle for the combustor of a gas turbine engine can be defined by the turn down ratio of the fuel injector, which is the ratio of the maximum lean-air fuel ratio before visible smoke emissions are evident, divided by the minimum fuel-air ratio before lean blow out occurs. In standard high shear designs the maximum turn down ratio achieved was approximately 7, 0.035 at maximum engine power, and 0.005 at snap deceleration, which is an aircraft operational mode typically used in military types of aircraft. This invention contemplates an improved fuel injector that is designed in accordance with these criteria.

In high shear fuel nozzles, the smoke emissions and lean blow out (LBO) improves when the large majority of the airflow is devoted to the inner passage and the outer passage is limited to approximately less than 15 percent (%) of the total flow and the swirl angle at the discharge is approximately 70°. From actual studies of heretofore fuel nozzles it was found that no one bulk swirl angle of the inner passage could be selected which would be universally good for both good smoke emissions and LBO. Bulk swirl angles at the discharge between 45°–50° tended to yield the best LBO performance while a swirl angle in excess of 60° was preferred for low smoke. Hence, in order to achieve any one of these objectives it is necessary to design the fuel nozzle with different swirl angles depending on which of the two criteria is desired.

As alluded to in the above paragraphs, the structure in the U.S. Pat. No. 5,603,211, supra, affords the low swirl and high swirl in the inner passage by confining the high swirl passage in the vicinity of the fuel injector and combining it with the counter-rotating annular passage surrounding the inner passage. However, it was found that the that there were disadvantages to this arrangement because the mixing shear layer between the two counter-rotating passages impeded the transport of the spray of the fuel to the prefilmer. Basically, the less the amount of flow in the counter-rotating passages the better the fuel injector performs. In addition, the mixing of the passages produced a pressure loss which dictated that the vane areas needed to be increased to levels larger than what would normally be required in a standard high shear design. The three wall arrangement resulted in greater coherent pressure fluctuation levels which would be unacceptable in certain combustor applications.

Figure 1:
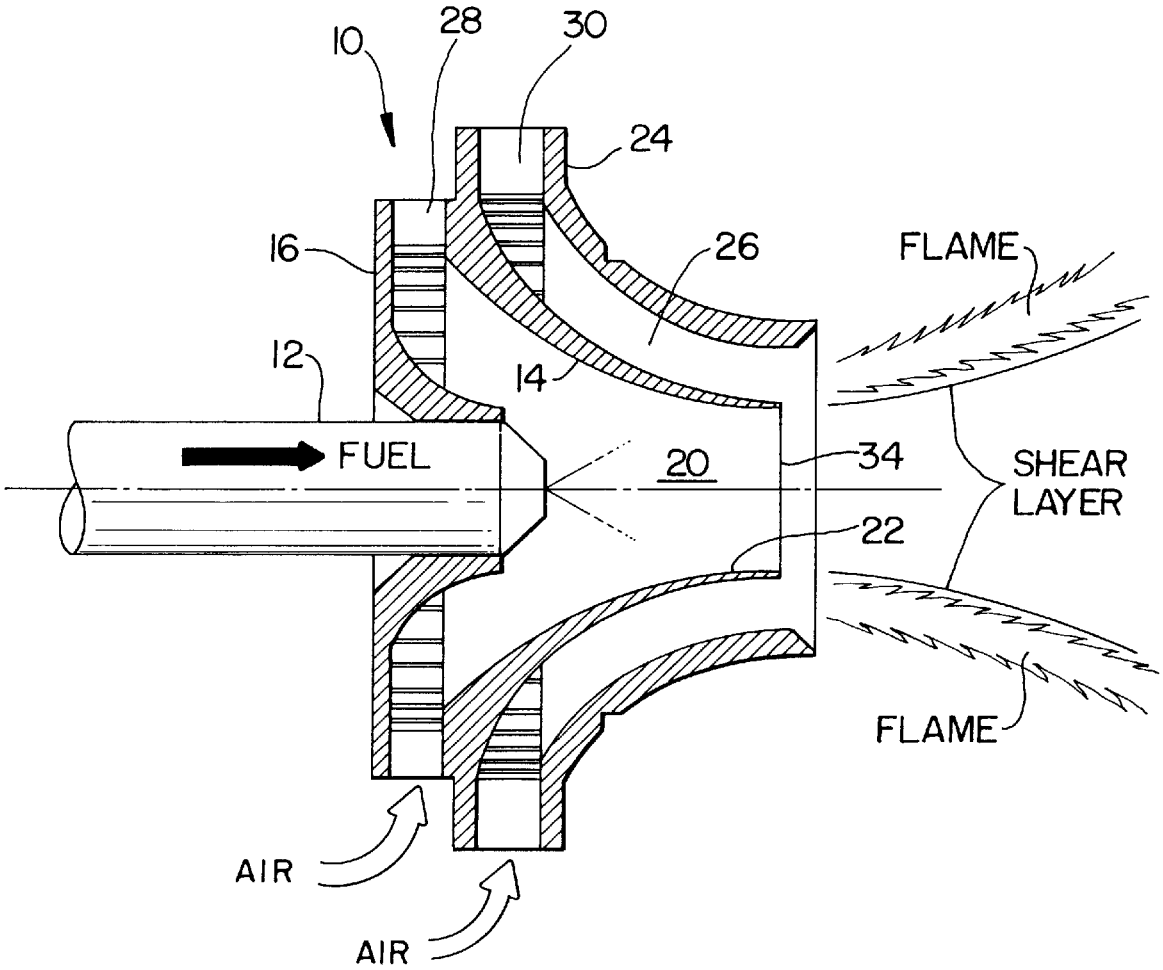
FIG. 1 is a sectional view showing the details of this invention and noting that the contour of the vanes are not seen in this view.

FIG. 1 discloses the general configuration of the fuel injector which is generally illustrated by reference numeral 10 comprised of the fuel nozzle 12 that includes the orifice located at the center line for injecting into the combustor and being affixed to the bearing plate 14 which typically is attached to the dome of the combustor (not shown). For further details of the attachment and the combustor components reference should be made to the U.S. Pat. No. 5,603,211, supra, and the patents noted therein which are incorporated by reference herein. The radial swirler 16 includes the torroidally shaped wall 18 which defines the inner passage 20 and surrounds the fuel injector and is disposed in co-axial arrangement therewith. The inner surface 22 of the wall 18 serves as the prefilmer which due to the swirling effect in passage 20 causes the fuel spray to be centrifuged to the wall where it forms into a film that is moved axially toward the discharge end. The outer radial swirler 24 is concentrically disposed relative to the inner radial swirler 16 and defines the outer passage 26. Each of the radial swirlers 16 and 24 carry circumferentially spaced vanes 28 and 30, respectively, which form vane passages. The structure, save for the vanes in the inner radial swirler 16, described in the immediate above paragraph is identical to the structure disclosed in the U.S. Pat. No. 5,603,211, supra, and for the sake of convenience and simplicity only the details of the inner passages will be described hereinbelow other than reference to other components where appropriate.

Essentially, this invention provides the same sort of swirl profile tailoring which is described in the U.S. Pat. No. 5,603,211, supra, while at the same time eliminating the disadvantages that are associated with that particular structure. An understanding of the tailored profile in the inner passage 20 (all reference numerals depict like parts in all the Figs. notwithstanding some of the Figs. are schematic illustrations) will be had from the description to follow hereinbelow. As noted in FIG. 3 the flow from the inner passage is divided into two regions. The first region is bounded by the fuel injector's center line and approximately 20% of the prefilmer radius. This is the solid body rotation region since swirl angle is proportional to the local radius. This region also defines the area where reverse flow occurs from the central recirculation zone. Since the amount of the flow is generally small it is neglected in this design The second region is located from 20% of the prefilmer radius to the prefilmer wall. It is characterized by a swirl angle which is inversely related to the local radius. This is the free vortex region and accounts for more than 95% of the flow through the inner passage. The various stations described below are subdivisions of the "free vortex" region.

Figure 2:
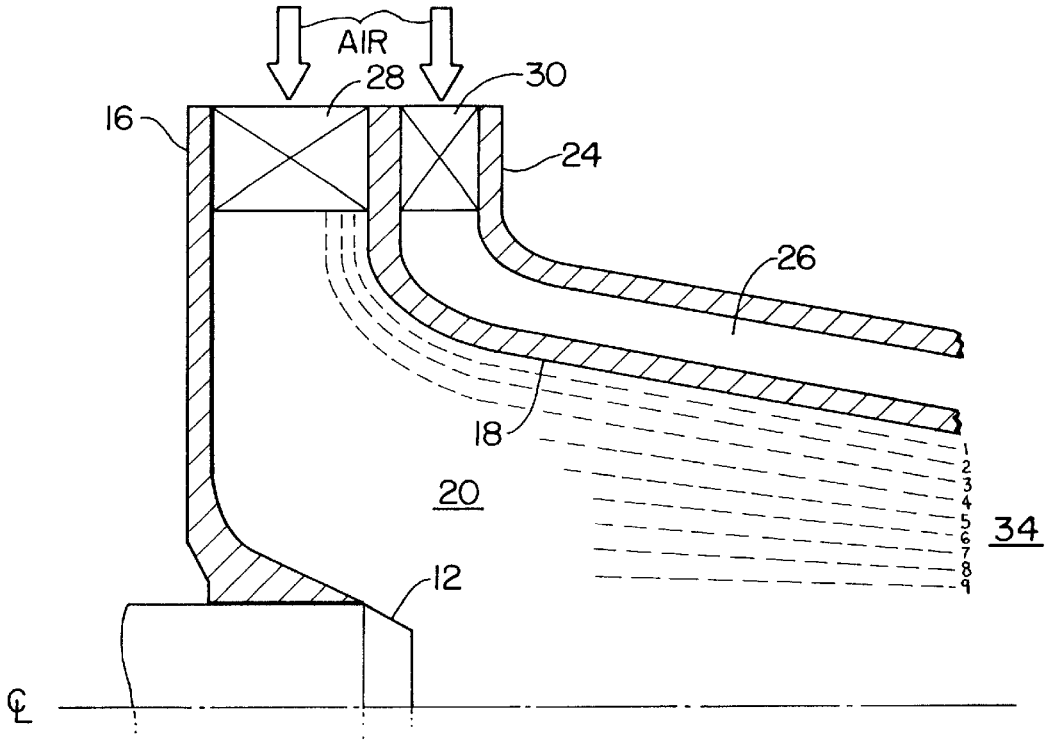
FIG. 2 is an exploded partial sectional view in schematic showing half of the fuel nozzle and the stations along the inner passageway.

As noted in FIG. 2 the inner passage 20 is divided into nine (9) stations which are at different radii. The swirl angle is plotted against each of these stations in FIG. 3 and show three (3) sample profiles from which would be found at the discharge of the radial inflow swirlers. Curves A, B and C which is the measured low swirl "high stability" profile, tailored profile and high swirl "low smoke" profile, respectively, are measured from the center line D and extend from the vane ends to the discharge 34 of inner passage 20. The profile of the outer passage is also plotted and is represented by curve E. As is apparent from the foregoing the basic structure of the swirl in the inner passage 20 at the discharge end is that of a Rankine vortex. The swirl angle is lowest at the prefilmer surface 18 and increases inversely with radius until a point at which viscous effects change the character of the profile from that of a free vortex to solid body rotation. In general, the profiles of the swirl of the radial inflow swirler are offset to a higher level than the low swirl radial inflow swirler.

Figure 3:
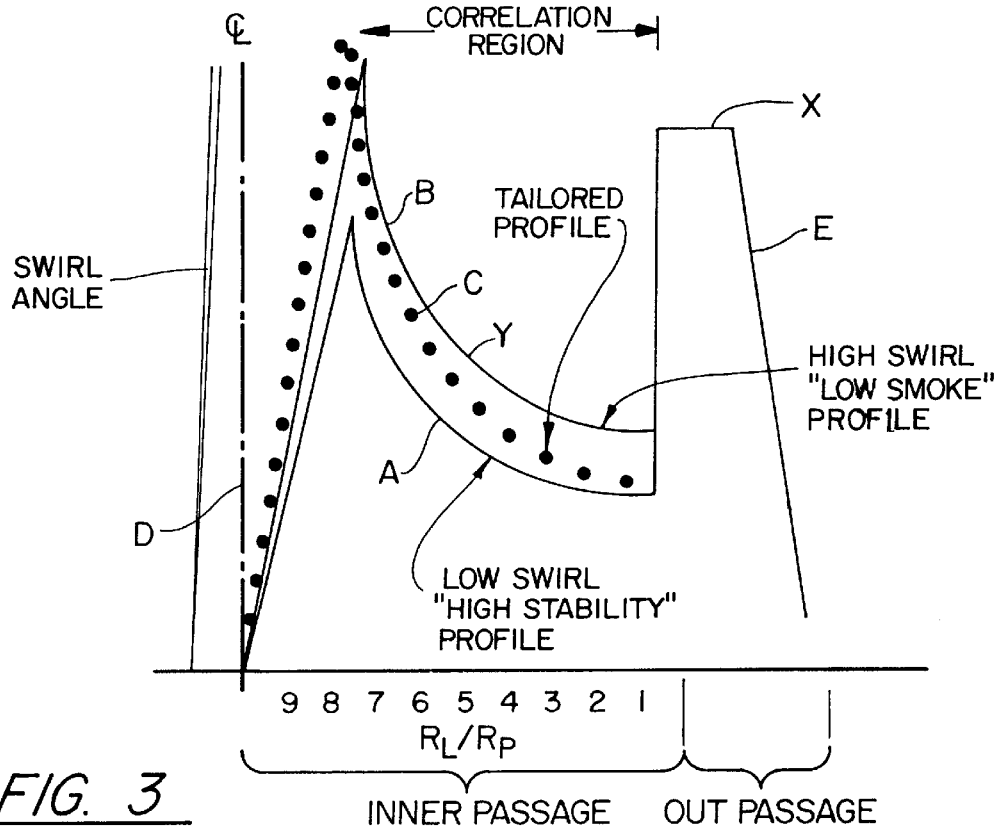
FIG. 3 is a graph plotting the swirl angle and the stations taken along the radius of the inner passage which is the ratio of local radius to prefilmer radius at the exit of the inner passage for comparing two swirl angle profiles.

Radial inflow swirler develops swirl angle profile characteristics as disclosed in FIGS. 2 and 3. The two passage design allows for the selection of the swirl angle profile on either side of the prefilmer. Since the outer passage 26 is annular and at a reasonably large radius, its swirl angle is nearly constant and obeys the slug flow calculation based upon flow continuity and conservation of angular momentum as noted by the following formula:

$$\tan\theta_0 = V_{to}/V_{Xo} = R_{vo}\sin\phi_I A_{eo}/\{\tfrac{1}{2}(R_p+R_o)A_{Vo}\} \qquad \text{Equation 1}$$

Where $\theta_0$=swirl angle outer passage $V_{to}$=velocity in tangential direction at annular passage $V_{Xo}$=velocity in axial direction at annular passage $R_{vo}$=radius of outer passage vane at slot discharge $\phi_I$=angle subtended by vane centerline and radius through that center line at slot discharge $A_{eo}$=Annular area at discharge; $\pi(R_o^2-R_p^2)$ $R_p$=prefilmer radius $R_o$=outer wall radius $A_{Vo}$=area of slots through outer passage vane The subscript "O" refers top the outer passage.

A similar slug flow calculation of the inner passage flow generally results in a reasonable value for estimating total flow which is obtained by the formula:

$$\tan\theta_I = V_{TI}/V_{XI} = R_{VI}\sin\phi_I A_{EI}^{2/3}/(R_p A_{VI})$$ Equation No. 2

The subscript I refers to the inner passage.

Because of the viscous effects, flow reversal occurs which complicates the overall profile and must be accounted for. The swirl angle most resembles a Rankine vortex in the inner passage. It has the features of a free vortex "Y" coupled with "solid body rotation" near the center line.

FIG. 3 illustrates the low swirl curve A and high swirl curve B profiles. Curve A profile shows a typical swirl angle profile which results in low smoke operation but has poor stability. Curve B profile is a profile with good stability but poor smoke characteristics. It should be noted that curves A and B show profiles that have the Rankine vortex character described above. These values could be extrapolated to develop a correlation of swirl angles as a function of the radial position for these characteristic prevails over the "free vortex" region. This produced the correlation as expressed in the following formula:

$$\theta_{(RL)} = \sin\phi C_1 R_V (A_e A_V)^{0.5} + C_2 (A_V/A_e)^{0.5} (R_V/R_L)$$ Equation No. 3

Where: $C_1$=21.25 and $C_2$=32.67 which are derived by experimentation.

It will be appreciated from the foregoing that some of the same parameters in equation number 2 exists in equation number 3. The key difference is that the formulation in equation number 3 is defined to determine the local swirl angle while the formulation in equation number 2 is defined to determine the global swirl angle. Therefore, "R" in equation number 3 defines the local Radius at which swirl is calculated. In these calculations the solid body rotation region was deemed negligible since the actual flow through that region accounts for less than 2% of the total flow.

It was postulated that the swirl angle at normalized radial location W was the critical value for stability while the swirl angle at normalized radial location V was the critical value for smoke reduction. Since these profiles were characteristic of the flow through a vane with a constant swirl angle (no twist) a profile could be generated so that the exit swirl characteristic has a value of the profile in curve A in the correlation region of FIG. 3 at location W and the value of the profile in curve A in the correlation region at location V, thus resulting in the tailored profile C. In order to achieve this end and according to this invention the vane in the inner passage must be twisted accordingly.

By considering the stations in FIG. 2 which are stream lines in the inner passage of the radial inflow swirler 16, flow from the vanes can be broken into stream tubes and the calculation can be run in reverse, so that a vane angle $\phi$ (output) can be determined to deliver a desired $\theta$ (input).

These equations can be calculated in a spreadsheet illustrated herein below to deliver the desired profile C as shown in FIG. 3. It was found that there is a correlation based on the area ratio between the vanes and the discharge, the swirl vane angle and the specific radial location at the discharge. In order to obtain the desired profile and in accordance with this invention a predetermined twist was incorporated in the vanes 28 of the inner swirler 16. An example of the twist that is necessary to achieve the proper profile is described in the following spreadsheet; noting that this is merely an example and that one skilled in the art can utilize these parameters and measurements and apply them for other sized fuel nozzles and applications.

| station | radius | discharge angle | area | vane angle | slot width | segment height |
|---|---|---|---|---|---|---|
| 1 | 0.522 | 24 | 0.164129 | 18.2037937 | 0.154341 | 0.0436 |
| 2 | 0.464 | 28 | 0.139969 | 19.4797317 | 0.153172 | 0.037466 |
| 3 | 0.406 | 33 | 0.115223 | 20.7498951 | 0.151934 | 0.031094 |
| 4 | 0.348 | 40 | 0.089054 | 22.3067994 | 0.150314 | 0.024291 |
| 5 | 0.29 | 52 | 0.058559 | 25.1143003 | 0.147113 | 0.01632 |
| 6 | 0.232 | 68 | 0.027713 | 27.3080212 | 0.144365 | 0.00787 |
| 7 | 0.174 | 88 | 0.001844 | 27.4252691 | 0.144213 | 0.000524 |
| 8 | 0.116 | | | 27.4252691 | 0.147643 | 0 |
| 9 | 0.058 | | | | | |

Vase design parameters are as follows:

| | | | |
|---|---|---|---|
| C. | −5.75 | Aeff Exit | 0.924563 |
| C2 | −2.73913 | A vane | 1.137213 |
| | | R vane | 0.92 |
| | | C. | 21.25 |
| | | C2 | 32.67 |
| | | Aratio | 0.9 |
| | | N vane | |
| | | Vane Thickness | |
| | Ψradians | Angle Segment | 0.1768 |
| | | chord | 0.1624 |
| | | height Va | 0.2480 |
| | | Rvane O | 1.0748 |

In accordance with this invention and in order to meet the desired twist as expressed in the profiles noted in the above paragraph, it is necessary to tailor the vanes 28 in the inner swirler 16 so that the twist is located in the top portion of the vanes. The angular spread from top to bottom was approximately 50% or an 8° increase above a 16° base. The resultant vane shown in this example varies from approximately 17.5° at the base of the vane to 27.4° at the top of the vane. The vanes in the outer swirler 24 are not twisted and have a generally constant thickness and configuration relative to each other. As was mentioned in the above paragraphs the portion of the swirl of the air in the inner passage 20 contains a solid body portion and a free vortex portion where the solid body portion constitutes about 2% of the total flow. Hence, in considering the design of the swirler 16 and inner passage 20 only the free vortex portion was considered which obviously accounts for 98% of the flow. The amount of air flow in the inner passage 20 should vary substantially between 70%–92% of the total air flow of the injector 10, thus the outer passage 26 will account from substantially between 30%–8% of the total air flow. The swirl angle at the discharge of the outer passage is substantially between 70°–75° and the swirl angle in the free vortex region shown as stations 1–9 in FIG. 2 will vary and increase in swirl from the lower stations closer to the prefilmer wall 18 toward the center line of the fuel injector 10 say from 25° to 90°. Thus station 1 would be at substantially 25° and station 9 would be at substantially 90°.

Figure 4:
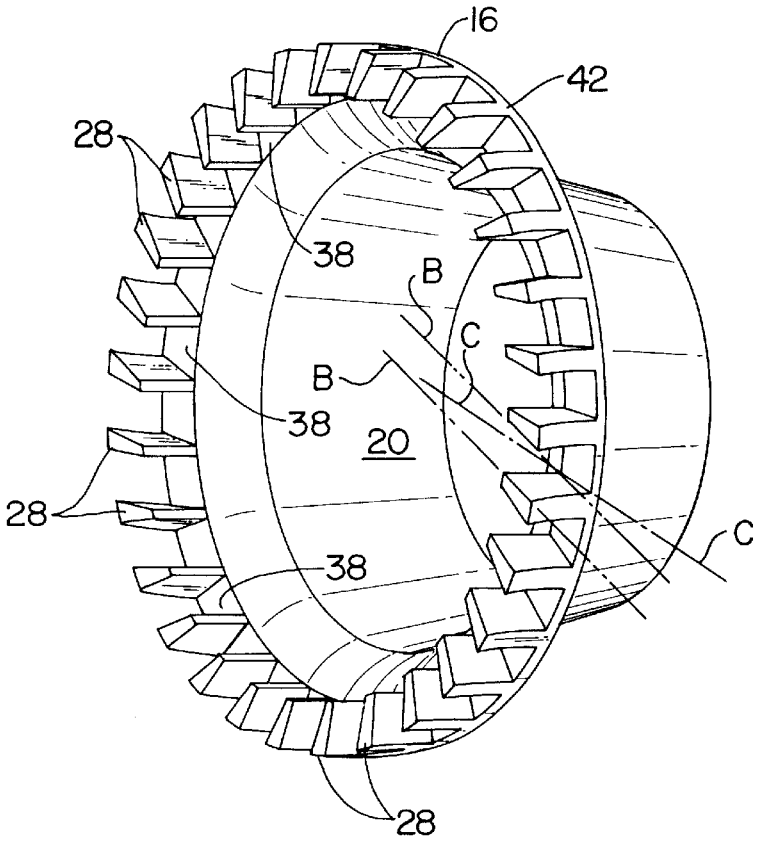
FIG. 4 is a perspective view illustrating a ring with the vanes of the inner swirler having the top portion thereof formed with a predetermined twist.
Figure 5:
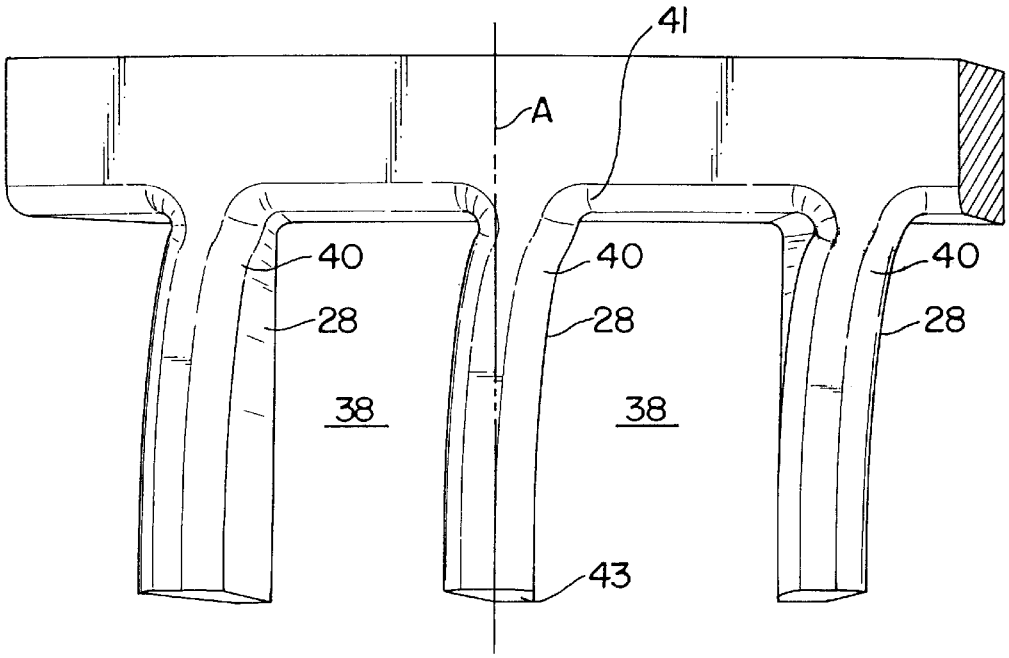
FIG. 5 is a partial enlarged perspective view of three vanes of the row of vanes in the inner passage and configured in accordance with this invention.

FIG. 4 exemplifies an annular vane construction showing the contour of the vanes 28 made in accordance with this invention for defining the vane passages 38. Top portion 43 of vanes 28 are twisted about central axis A of each vane extending to base portion 41 in order to obtain the profile shown as curve C in FIG. 3. A more detailed view of the twist in the top portion 40 of vanes 28 is shown in the exploded view of FIG. 5. The vanes are supported to the ring 42. It is apparent from the foregoing that the twist is about the central axis A of each vane and to have a better understanding of the twist imaginary lines B & B' have been extended through the top portion of adjacent vanes 28 in FIG. 4 and it being noted that imaginary lines B and B' are parallel to each other. The same treatment has been given to the base portion of the blade where only one imaginary line C is drawn through a base of a vane in FIG. 4. However if an imaginary line was extended through the next adjacent vane as was done in the top portion, these lines would be parallel. It will be noted that the imaginary lines B–B' are not parallel to the imaginary line C, This provides a showing of the twist in the vane 28.

Figure 6:
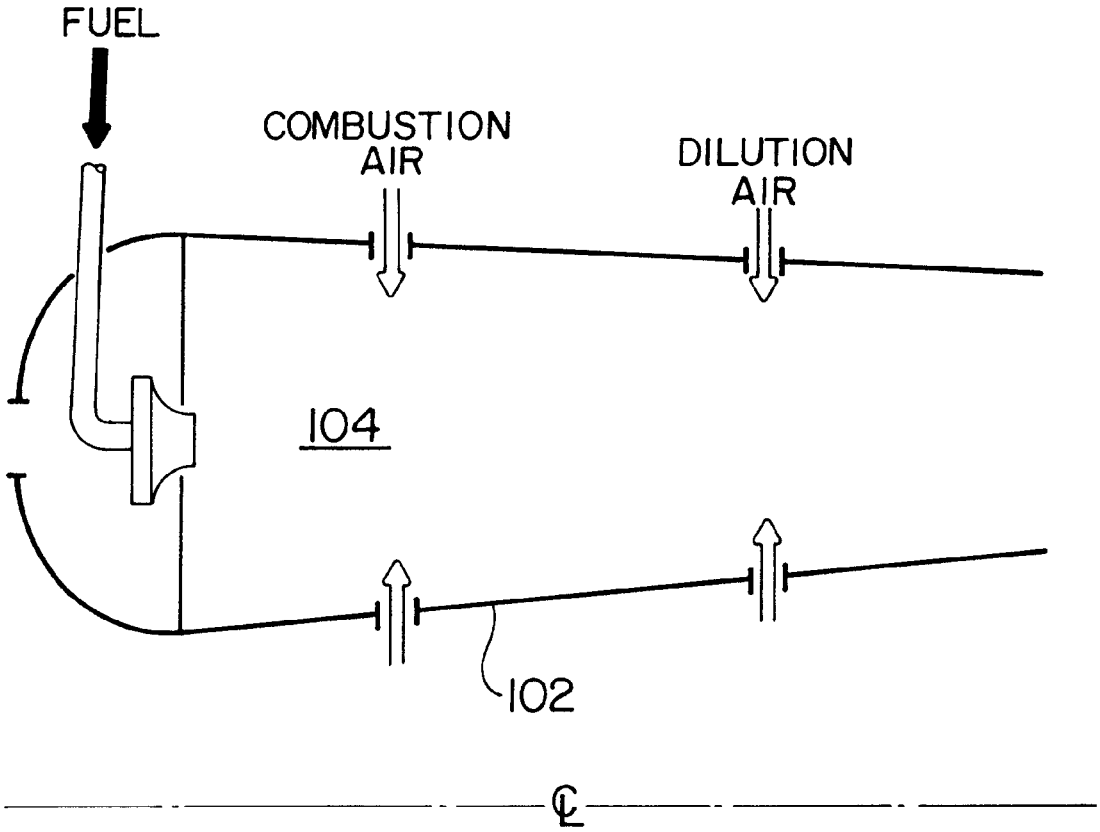
FIG. 6 is a schematic illustration of the fuel injector mounted on a combustor of a gas turbine engine.

As shown in FIG. 6 the fuel injector 10 is mounted in the dome 100, of the annular combustor 102 for injection fuel and air into the combustion zone 104 where the air (compressed by the compressors of the engine, not shown) is heated in the combustion process and the gaseous products are accelerated to provide the energy to power the turbines and develop thrust or horsepower depending on whether the gas turbine power plant is of the turbo-jet, jet or turbo-prop type.

It was theorized that the increased vane area to compensate for pressure losses in previous designs attributed to greater acoustic transmittance between the shroud and combustion chamber regions, or the acoustic disturbance could be related to the additional shear layer created in the vicinity of the fuel nozzle or it may have been the result of vortex shedding from the venturi which separated the innermost passage and the middle passage that is in the three passage fuel injector configuration. Whatever the cause, these problems were not evidenced in actual testing of the present invention. A number of tests were conducted and the vane configuration of this invention was as good as or in some instances better than heretofore known high shear swirlers.

Although this invention has been shown and described with respect to detailed embodiments thereof, it will be appreciated and understood by those skilled in the art that various changes in form and detail thereof may be made without departing from the spirit and scope of the claimed invention.

I claim:

1. A high shear designed fuel injector for a combustor of a gas turbine engine comprising a fuel nozzle supported at an inlet of said combustor, a first radial inlet swirler mounted on said fuel nozzle and including a first passage for flowing air into the combustor and being coaxially disposed relative to said fuel nozzle, a second radial inlet swirler mounted adjacent to said first radial swirler and including a second passage for flowing additional air into the combustor and being concentrically disposed relative to said first passage, said first radial inlet swirler having circumferentially disposed vanes, said vanes having a top section and a base section each having a swirl angle, the base section being attached to a radially extending wall of said first or second passage, said vanes being configured with a twist, said twist being about a central axis extending from and changing the swirl angle from the top section to the base section to offset the swirl to a higher level that the swirl would be without twisting the vanes to produce a Rankine vortex.

2. A high shear designed fuel injector as claimed in claim 1 wherein said second swirler includes circumferentially spaced vanes that have no twist configuration.

3. A high shear designed fuel injector as claimed in claim 2 wherein a majority of the air in the first passage and second passage is in the first passage.

4. A high shear designed fuel injector as claimed in claim 3 wherein the amount of air in the first passage is substantially equal to 70%–92% of the total air flow in the first passage and second passage.

5. A high shear designed fuel injector as claimed in claim 4 wherein a bulk swirl angle of air at a discharge of said second passage is substantially equal to between 70°–75°.

6. A high shear designed fuel injector as claimed in claim 5 where a swirl angle of the air at a discharge of said first passage in a free vortex region is progressively larger from a center of the fuel injector to a prefilmer wall.

7. A high shear designed fuel injector as claimed in claim 6 wherein the swirl angle of the air closest to said center at the discharge end of said first passage is substantially equal to 90° and the swirl angle of the air closest to the prefilmer wall at the discharge of said first passage is substantially equal to 25°.

8. A high shear designed fuel injector as claimed in claim 1 wherein the base of the vane angle is substantially equal to 16° and the twist has an angular spread of 8° above said base.

9. A high shear designed fuel injector as claimed in claim 1 wherein the spread from top to bottom is substantially equal to 50%.

10. A high shear designed fuel injector for a combustor of a gas turbine engine comprising a fuel nozzle mounted in a front end of said combustor, a first radial inlet swirler including a first passage for flowing air into the combustor and being coaxially disposed relative to said fuel nozzle and supported thereto, a second radial inlet swirler including a second passage for flowing additional air into the combustor and being concentrically disposed relative to said first passage and being mounted thereto, said first swirler having circumferentially disposed vanes having a top section and a base attached to a radially extending wall of said first or second passage, said vanes being configured with a twist extending from the top section to said base, the base having a vane angle substantially equal to 16° and the twist having an angular spread of 8° above said base for producing a Rankine vortex.

11. A high shear designed fuel injector as claimed in claim 10 wherein the amount of air in the first passage is substantially equal to 70%–92% of the total air flow in the first passage and second passage.

12. A high shear designed fuel injector as claimed in claim 11 wherein a bulk swirl angle of air at a discharge of said second passage is substantially equal to between 70°–75°.

13. A high shear designed fuel injector as claimed in claim 12 where a swirl angle of the air at a discharge of said first passage in a free vortex region is progressively larger from a center of the fuel injector to a prefilmer wall.

14. A high shear designed fuel injector as claimed in claim 13 wherein the swirl angle of the air closest to said center at the discharge end of said first passage is substantially equal to 90° and the swirl angle of the air closest to the prefilmer wall at the discharge of said first passage is substantially equal to 25°.

* * * * *